US010975553B2

(12) United States Patent
Kuhbier et al.

(10) Patent No.: US 10,975,553 B2
(45) Date of Patent: Apr. 13, 2021

(54) DEVICE, SYSTEM AND METHOD FOR AUTOMATIC FLUSHING WITH A MULTIPLE VALVE

(71) Applicant: Viega Technology GmbH & Co. KG, Attendorn (DE)

(72) Inventors: Ulrich Kuhbier, Herscheid (DE); Verena Stelthove, Lennestadt (DE); Tobias Klosta, Siegen (DE)

(73) Assignee: Viega Technology GmbH & Co. KG, Attendorn (DE)

( * ) Notice: Subject to any disclaimer, the term of this patent is extended or adjusted under 35 U.S.C. 154(b) by 463 days.

(21) Appl. No.: 15/752,749

(22) PCT Filed: Aug. 8, 2016

(86) PCT No.: PCT/EP2016/068873
§ 371 (c)(1),
(2) Date: Feb. 14, 2018

(87) PCT Pub. No.: WO2017/032584
PCT Pub. Date: Mar. 2, 2017

(65) Prior Publication Data

US 2018/0238029 A1 Aug. 23, 2018

(30) Foreign Application Priority Data

Aug. 21, 2015 (DE) ..... 10 2015 113 886

(51) Int. Cl.
*E03B 7/08* (2006.01)
*E03B 7/07* (2006.01)
(Continued)

(52) U.S. Cl.
CPC ..... *E03B 7/08* (2013.01); *B08B 9/0325* (2013.01); *E03B 7/006* (2013.01); *E03B 7/071* (2013.01);
(Continued)

(58) Field of Classification Search
CPC . Y10T 137/87298; E03C 1/055; E03C 1/284; E03C 1/1222; E03C 1/288;
(Continued)

(56) References Cited

U.S. PATENT DOCUMENTS 4,244,396 A * 1/1981 Friedland ..... F15B 11/0426 137/487.5
6,463,956 B2 10/2002 Walker
(Continued)

FOREIGN PATENT DOCUMENTS

CN 1326524 A 12/2001
CN 101133373 A 2/2008
(Continued)

*Primary Examiner* — Atif H Chaudry
(74) *Attorney, Agent, or Firm* — The Webb Law Firm

(57) ABSTRACT

The invention relates to a device (2) for automatically flushing liquid lines, in particular drinking water lines, with at least one connection (4) for a water conduit, with at least one connection (6) for a wastewater conduit, and with a flushing valve (8) which is arranged between the connections for the water conduit and wastewater conduit. The object of providing a device for automatic flushing that allows a flushing behaviour which is better tailored to the conditions is achieved in that the flushing valve (8) comprises a multiple valve with parallel valves (10). The invention further relates to a system of water lines and to a method for automatically flushing water lines using a device according to the invention.

18 Claims, 5 Drawing Sheets

Figure 1:
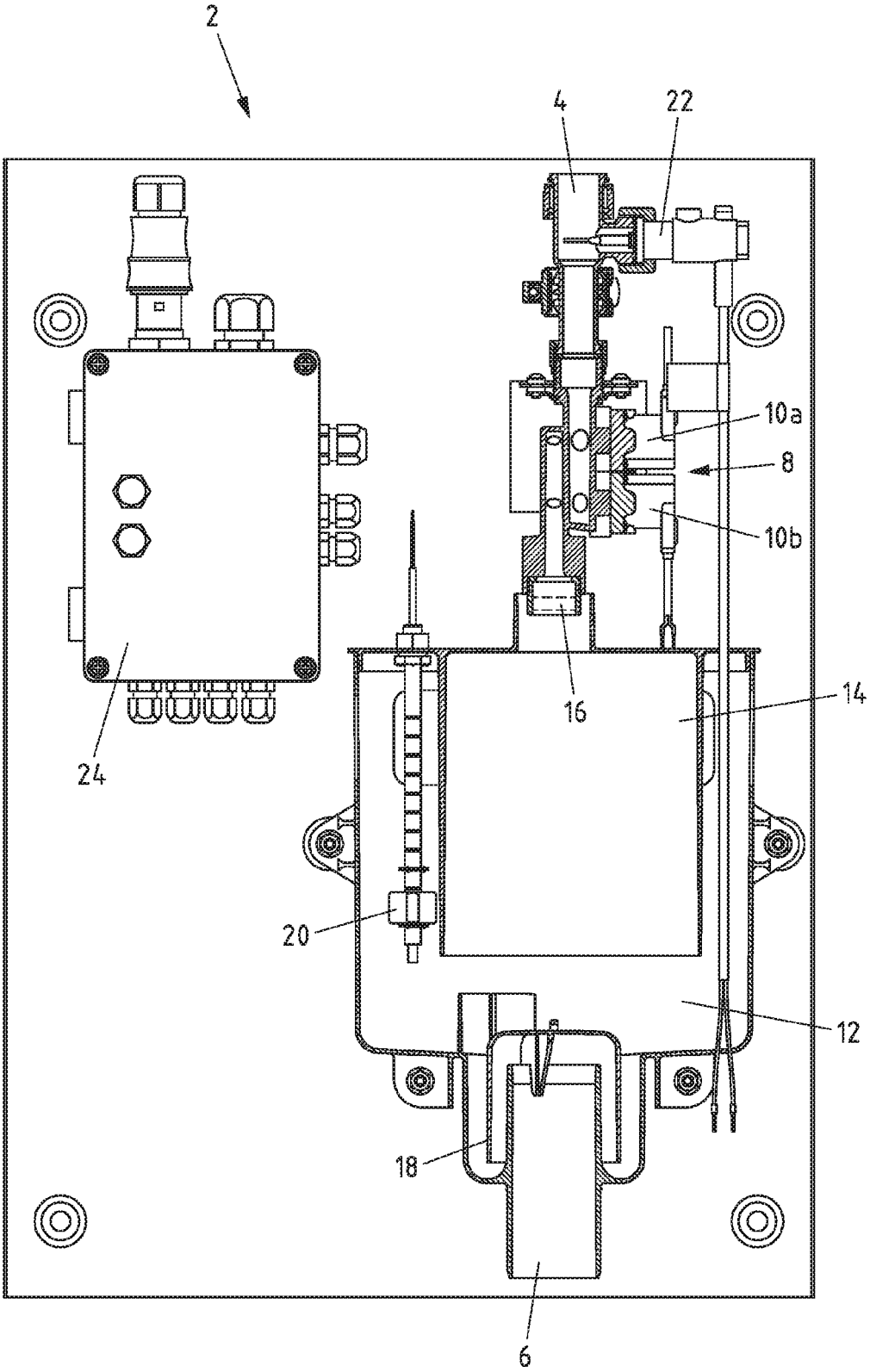

(51) Int. Cl.

| | |
|---|---|
| ***E03C 1/284*** | (2006.01) |
| ***E03C 1/288*** | (2006.01) |
| ***E03C 1/122*** | (2006.01) |
| ***E03C 1/05*** | (2006.01) |
| ***B08B 9/032*** | (2006.01) |
| ***E03B 7/00*** | (2006.01) |
| ***F24D 17/00*** | (2006.01) |

(52) U.S. Cl.
CPC ..... *E03C 1/055* (2013.01); *E03C 1/1222* (2013.01); *E03C 1/284* (2013.01); *E03C 1/288* (2013.01); *F24D 17/0073* (2013.01); *Y10T 137/87298* (2015.04)

(58) Field of Classification Search
CPC . E03B 7/006; E03B 7/071; E03B 7/08; B08B 9/0325; F24D 17/0073
See application file for complete search history.

(56) References Cited

U.S. PATENT DOCUMENTS

| | | | | |
|---|---|---|---|---|
| 7,240,853 | B2 * | 7/2007 | Taylor | A61H 33/00 236/46 R |
| 8,043,556 | B2 | 10/2011 | Peel et al. | |
| 9,695,577 | B2 | 7/2017 | Leymann et al. | |
| 2003/0015326 | A1 * | 1/2003 | Haase, III | A62C 35/60 169/16 |
| 2005/0103693 | A1 * | 5/2005 | Palm | E03B 7/08 210/138 |
| 2008/0112843 | A1 | 5/2008 | Peel et al. | |
| 2010/0175762 | A1 * | 7/2010 | Anacrelico | D06F 39/081 137/387 |
| 2014/0251379 | A1 * | 9/2014 | Mackenzie | B08B 9/0321 134/18 |

FOREIGN PATENT DOCUMENTS

| | | | | |
|---|---|---|---|---|
| CN | 204570794 | U | 8/2015 | |
| DE | 19539879 | A1 | 4/1997 | |
| DE | 202008002822 | U1 | 7/2009 | |
| DE | 102011013955 | A1 | 9/2012 | |
| DE | 202014008946 | U1 | 11/2014 | |
| DE | 202014104154 | U1 * | 12/2014 | E03B 7/078 |
| DE | 202014104154 | U1 | 12/2014 | |
| DE | 202014105702 | U1 * | 12/2014 | E03B 7/08 |
| DE | 202014105702 | U1 | 12/2014 | |
| EP | 1964983 | B1 | 10/2010 | |
| WO | 2006077396 | A1 | 7/2006 | |

* cited by examiner

DEVICE, SYSTEM AND METHOD FOR AUTOMATIC FLUSHING WITH A MULTIPLE VALVE

CROSS-REFERENCE TO RELATED APPLICATIONS

This application is the United States national phase of International Application No. PCT/EP2016/068873 filed Aug. 8, 2016, and claims priority to German Patent Application No. 10 2015 113 886.7 filed Aug. 21, 2015, the disclosures of which are hereby incorporated in their entirety by reference.

The invention relates to a device for the automatic flushing of liquid lines, in particular drinking water lines, with at least one connection for a water conduit, with at least one connection for a wastewater conduit and with a flushing valve that is arranged between the connections for the water conduit and wastewater conduit. The invention furthermore relates to a system of water lines with a device according to the invention, with a water conduit connected to the device and with a wastewater conduit connected to the device. Furthermore the invention relates to a method for the automatic flushing of water lines using a device according to the invention.

Devices, systems and methods of the type mentioned above are already known from the prior art. If liquid lines are not constantly used, then in certain cases deposits can form in the pipes conveying the liquid, which can interfere in the liquid transport or block parts of the line system. In addition microorganisms such as bacteria, for example Pseudomonae or Legionellae, can form especially in drinking water lines and represent a danger to health for humans. Regular use of the water lines obviates this danger. However, a regular use of the lines is often not possible, since for example hotel rooms or hospital rooms may not be occupied for prolonged periods or public buildings may be closed for prolonged periods. For this reason devices and methods have been developed in order to initiate the flushing of the lines automatically.

Thus, for example, a method is known from EP 1 964 983 B1 that can electronically actuate the flushing of a drinking water system via a central controller.

Yet, even by means of these methods bacteria cannot reliably be prevented from multiplying in the drinking water lines. There is therefore a need to ensure an improved hygiene. For example, the flushing frequency or duration can be increased, in order to ensure a better hygiene. A repeated flushing has however at the same time the disadvantage that the flushing can take place at times that disturb residents, for example during sleeping hours. Also, the energy consumption involved in a more frequent flushing is regarded as a disadvantage.

A sanitary arrangement with a flushing valve, which can be controlled electrically, is known from document DE 20 2014 105 702 U1. A control unit is provided to control the flushing valve depending on a water temperature, a flow or a time.

In DE 20 2014 104 154 U1 a flushing device within a water installation is described, which flushes the water installation depending on a measured quantity of consumed water.

From EP 1 964 983 A1 magnetic valves for automatic flushing of water lines are known, which are connected and controlled in a central manner by means of a central control unit.

DE 20 2008 002 822 U1 relates to a valve to be controlled automatically. A control unit is provided to control the valve depending on a time delay, a temperature or a detected leak.

Against this background the object of the invention is therefore to provide a device, a system and a method for automatic flushing, which allow a flushing behaviour better suited to the specific circumstances.

According to a first teaching of the invention the object is achieved by means of a device for the automatic flushing of liquid lines, in which the flushing valve comprises a multiple valve with parallel valves.

The device according to the invention comprises at least one connection for a liquid conduit and at least one connection for a drainage conduit. The connections serve to provide in particular liquid-tight and pressure-tight connection to a liquid conduit conveying a liquid, the contents of which can be emptied via an automatic flushing at least partially into a drainage conduit.

One or more pipe sockets or fittings for the connection to pipes may be provided as connections. The connections can be dimensioned corresponding to the lines to be connected thereto, for example the connections for pipes can be designed with standard nominal sizes of DN 8 to DN 150 according to DIN EN ISO 6708, in particular for DN20 to DN100.

As mentioned in the introduction, in particular a water conduit or drinking water conduit is suitable as liquid conduit, for example within a building or a floor of a building. The device according to the invention can be used in order to automatically flush the contents of the water conduit into the public water disposal system connected to the connection for a drainage conduit, and in particular to obviate the danger of deposits, impurities and formation of germs.

At least one flushing valve is arranged between the connections for the liquid conduit and drainage conduit. The flushing valve in the closed state within the device blocks the access from the connection for a liquid conduit to the connection for a drainage conduit. The flushing valve can be opened for the automatic flushing of liquid lines connected to the device, and a flushing procedure can thereby be initiated.

The flushing valve comprises a multiple valve with parallel valves. In this way the liquid stream and the volume of liquid conveyed in the stream by a liquid conduit connected to the device can be controlled in a simple way during a flushing procedure by opening a certain number of parallel valves. The parallel valves, which are connected to the liquid conduit via the connection, allow the volume flow to be multiplied compared to a single valve. In particular the parallel valves have in each case the same flow cross-section.

Preferably the flushing valve is arranged between a single connection for a liquid conduit and a single connection for a drainage conduit, whereby the device can be constructed in a particularly compact and simple manner.

By means of the multiple valve the volume flow can be regulated stepwise, in which individual vales are completely open or completely closed. In principle a continuous regulation by partial opening or closure of individual valves is also possible.

In particular with larger liquid lines and large maximum volume flows for the automatic flushing, an appropriately large individual valve is used in the prior art. Larger valves are however generally less suitable for a fine adjustment of the volume flow. This problem can be avoided by the use of multiple valves arranged in parallel, in which if small volume flows are required only a few valves or an individual valve of the multiple valve is opened. A fine adjustment of the volume flow is thereby possible, while additional valves can easily be opened in order to provide a large volume flow.

Also, the same construction of the device according to the invention can be employed for a plurality of differently large fluid conduits. The number of used parallel valves from the multiple valve can vary depending on the size of the liquid line to which the device is connected. The construction and production of devices in different sizes or with individual valves of different sizes for the automatic flushing can thereby be dispensed with, which increases the economy of the device.

It has also been found that the volume flows through the individual open valves can be achieved substantially independently of the pressure in the liquid line, for example in the range from 2 to 10 bar. In this way, by using the device according to the invention, liquid lines can be flushed in a controlled manner by a choice of the number of open valves and largely independently of the pressure in the liquid line.

In an embodiment of the device according to the invention the multiple valve comprises parallel magnetic valves. Magnetic valves can be controlled in particular by electronic circuitry and are thus suitable for automation. Magnetic valves also enable rapid switching times to be achieved.

It has been found that a quadruple magnetic valve in particular is suitable in order to cover a large number of applications for automatic flushing. In this connection the four parallel valves of the quadruple magnetic valve have respectively the same dimensions. The volume flow through the valve can thus be regulated by completely opening individual valves within four stages. For example, four magnetic valves each with a volume flow of 12 l/min (±10%) can be used, whereby the volume flow can be regulated in the stages 0→12→24→3→48 l/min (±10% respectively) depending on the connected liquid line or also depending on the operating mode and flushing procedure. However, a continuous regulation is in principle also possible by a partial opening of individual magnetic valves.

In particular it is advantageous if the multiple valve provides a maximum volume flow of at least 30 l/min, preferably 45 l/min. This order of magnitude has proved to be adequate for many sizes of liquid lines and also for large pipe diameters, so as to allow flushing procedures with short flushing durations. Short flushing durations are advantageous for avoiding noise pollution.

In principle it is possible for the connection for a drainage conduit to be designed for a pressurised drainage conduit. In a further development of the device according to the invention a free discharge is however arranged between the flushing valve and the connection for a drainage conduit. In this way a discharge of the liquid from the liquid conduit can be ensured in a simple manner. In particular the free discharge is designed so that this meets the requirements of a free discharge of the AB type according to DIN EN 1717. In particular the free discharge has no circular cross-section.

In particular the connection for a drainage conduit is designed having a jet control. A jet control is a component that controls the flow of the liquid in relation to the shape of its jet, for example in the form of a nozzle. In this way, especially in the case of a free discharge, the shape of the exiting free jet can be influenced, for example focused. A jet control at the same time allows an even and uniform outflow jet.

In a further development of the device according to the invention a backflow vessel is provided. A backflow vessel, in particular between the flushing valve and the connection for a drainage conduit, provides a containment volume that for example in the case of a volume flow through the open valve that is too large for the size of the drainage conduit or a blocked drainage conduit, prevents the liquid drained by the flushing from being forced back into the liquid line.

In the case of a backflow the backflow vessel first of all fills with liquid before this liquid reaches the liquid conduit. A safe automatic flushing is thereby assisted. Particularly for drinking water lines, a contamination of the fresh water with wastewater flowing back due a backflow is avoided.

In a further development of the device according to the invention a backflow sensor is provided. A backflow sensor monitors whether owing to a backflow in a flushing procedure liquid flows back from the drainage conduit and threatens to enter the liquid line. Accordingly a backflow can be detected beforehand and if necessary, by a timely closure of the flushing valve, liquid from the drainage conduit can be prevented from flowing through the flushing valve and reaching the liquid conduit. The backflow sensor can in particular comprise a floating sensor or a floating switch, which monitors the liquid level in the drainage conduit and/or in a backflow vessel. The use of a pressure switch as backflow sensor is also conceivable.

The combination of a backflow sensor with a backflow vessel is thus particularly advantageous. The backflow vessel can be dimensioned and arranged with the backflow sensor so that the volume of the backflow vessel is sufficient to close the flushing valve within its switching time, before liquid from the drainage conduit can enter the liquid conduit. In this connection a floating switch can be provided in order to monitor the liquid level in the backflow vessel. The use of one or more pressure switches at different liquid level positions within the backflow vessel is also possible.

In a further development of the device according to the invention an odour trap is arranged between the flushing vale and the connection for a drainage conduit. For this, one of the various known designs of a trap can be used, for example a pipe trap or cylinder trap. An odour trap in the form of a valve is also conceivable. An odour trap prevents an escape of gases from the drainage conduit, which is advantageous especially in the case of a free discharge.

In a further development of the device according to the invention the flushing valve includes at least one flow limiter, in particular at least one flow limiter in each valve of the multiple valve. In this way the flow through the flushing valve can be better regulated. In particular this helps to ensure that the volume flows through the individual open valves can be regulated substantially independently of the pressure in the liquid line.

In a further development of the device according to the invention a control unit is provided, which controls the opening and closing of the individual valves in the flushing valve. The regulation of the flushing procedures and optionally the monitoring of parameters of the device can be integrated via a control unit into the device. The control unit can for example initiate and terminate flushing procedures via external parameters in a time-dependent manner. The control unit can be remotely controlled, in particular can be coupled to other central control units. Also, internal parameters, for example the temperature at certain points within the liquid line, the flow amount or also the pressure, can be monitored by the control unit and included in a calculation of the flushing procedures, in particular the number of parallel valves to be opened in the multiple valve, but also the timing and the duration of the flushing procedures.

In a further development of the device according to the invention a flow sensor is provided. The flow sensor can be arranged between the connection for a liquid conduit and the flushing valve or between the flushing valve and the connection for a drainage conduit, and can record a flow of the liquid, possibly also the pressure and the flow rate. A flow sensor between the connection for a liquid conduit and the flushing valve can serve in particular to monitor leakages and detect the flow of liquids for example in the case of an inadvertently not fully closed or leaking flushing valve.

According to a second teaching of the present invention the aforementioned object is achieved by a system of flushing lines, in particular drinking water lines, with a device according to the invention, with a liquid conduit connected to the device and with a drainage conduit connected to the device.

The liquid conduit includes in this connection one or more loop lines or linear lines that convey liquid. In particular the liquid conduit comprises along the lines one or more consumers such as taps or fittings to drainage points. With the device according to the invention an automatic flushing of the liquid conduit can be accomplished as described above. An opening of the flushing valve creates a liquid pathway between the liquid conduit and the drainage conduit, whereby the liquid from the liquid conduit can be at least partially drained or replenished when the liquid conduit is connected to a liquid source. In a flushing procedure the number of open parallel valves of the multiple valve can be regulated, for example matched to the size of the liquid conduit.

For the configurational arrangements of the system according to the invention reference is made to the above embodiments of the device according to the invention. In addition it is possible with a system to arrange sensors at different places along the liquid conduit in order to influence the flushing procedure with the measurement values. For example, the feed line from a liquid source, but also individual consumers or secondary conduits of the liquid conduit, can be monitored with sensors and the amount of liquid to be drained and also the number of parallel valves of the multiple valve to be opened within a flushing procedure can be determined.

According to a further teaching of the present invention the above object is achieved by a method for the automatic flushing of liquid lines, in particular drinking water lines, using a device according to the invention, wherein flushing procedures are provided in which the multiple valve for flushing a liquid conduit is opened and is closed again after a flushing duration.

If the liquid conduit is not continuously used, then under certain conditions deposits or impurities can form. A regular flushing of the liquid line avoids this danger. The method according to the invention includes such flushing procedures in order to supply liquid from the liquid conduit to the drainage conduit.

The opening and closing of the multiple valve can be controlled in particular by a control unit, especially in a time-dependent, temperature-dependent manner and/or depending on the flow rate through the liquid conduit.

In particular the number of valves in the multiple valve that have to be opened in a flushing procedure is fixed in a time-dependent, temperature-dependent manner and/or depending on the flow rate through the liquid conduit. The volume flow from the liquid conduit through the flushing valve into the drainage conduit can thereby be regulated. For example, the number of valves to be opened can be matched to the volume to be flushed and/or to the flushing duration.

In a further development of the method according to the invention a flushing procedure is automatically ended in the event of a backflow. A backflow can be detected by a backflow sensor and can effect an automatic closure of the flushing valve, so as to prevent liquid from the drainage conduit entering the liquid conduit. Especially with drinking water lines a contamination of the fresh drinking water by wastewater flowing back is thereby prevented.

Figure 2:
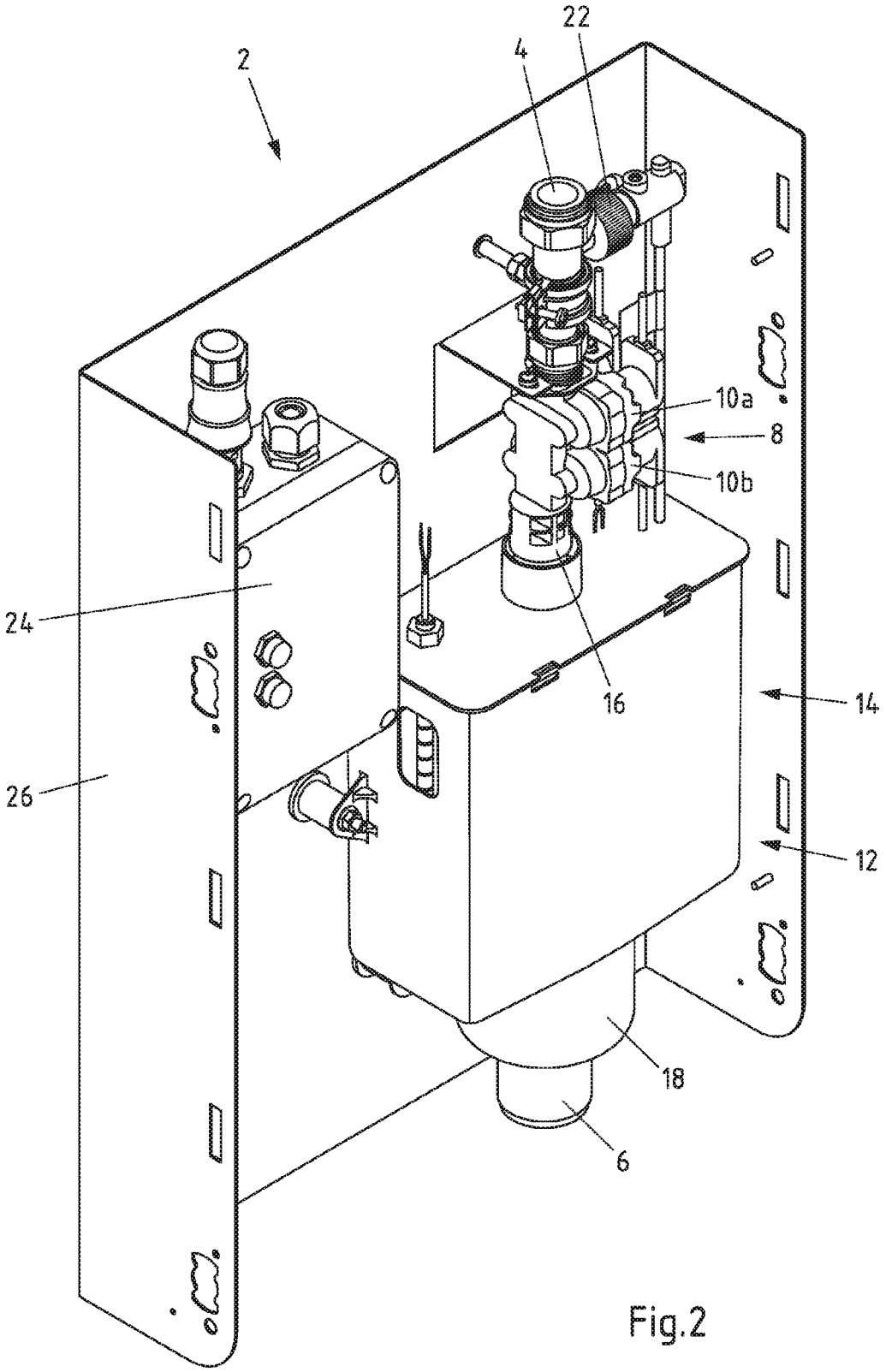
Figure 3:
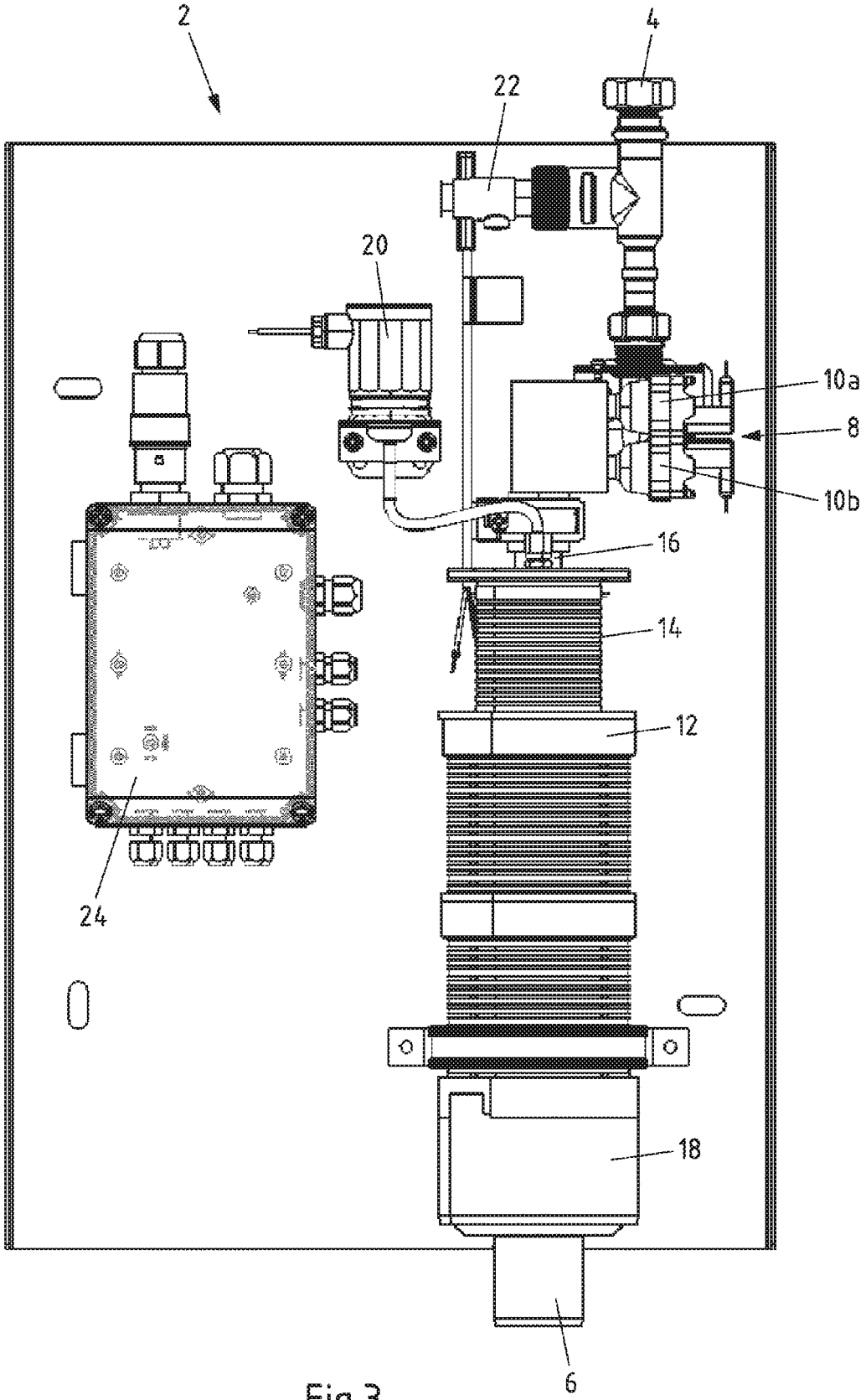
Figure 4:
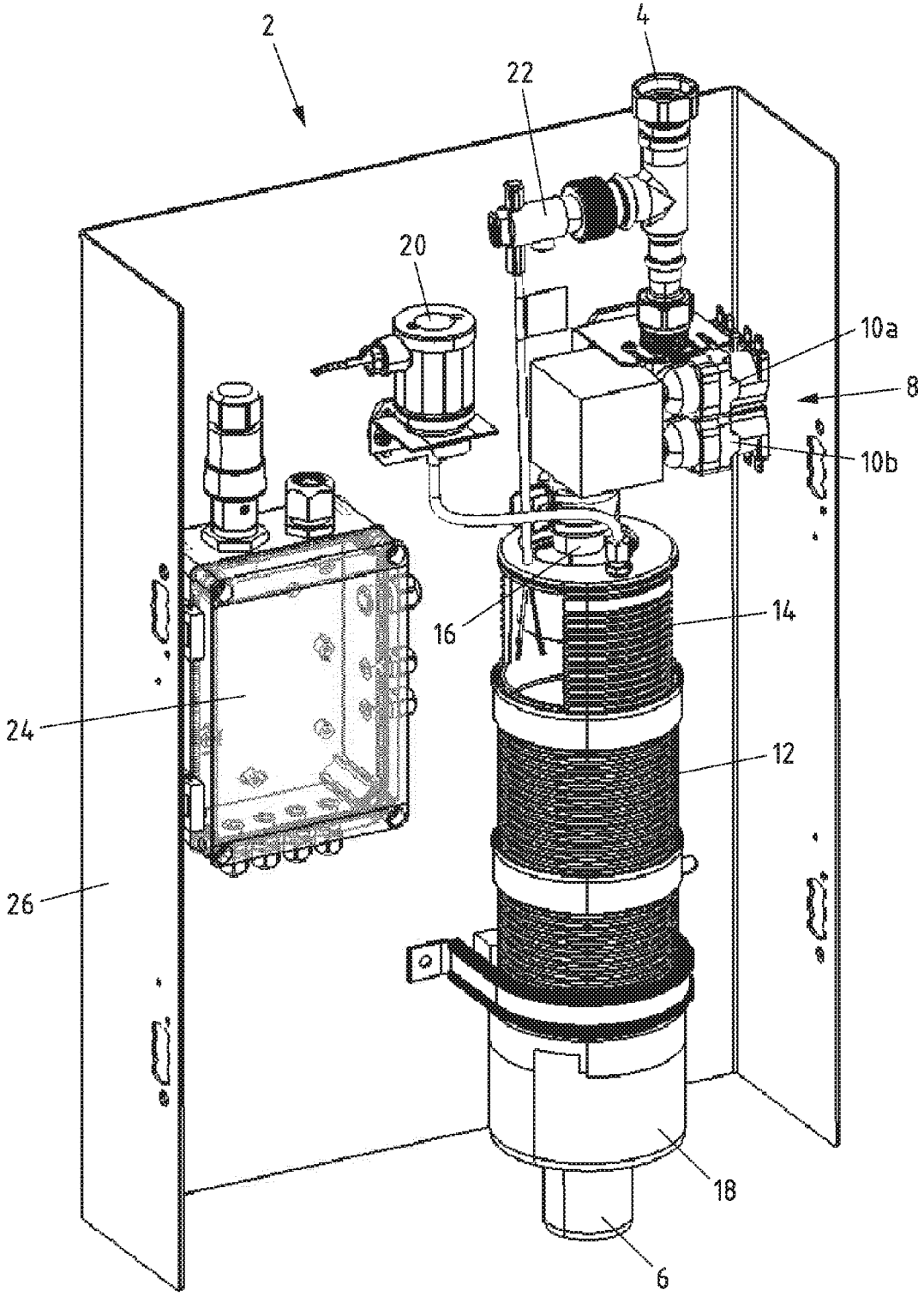
Figure 5:
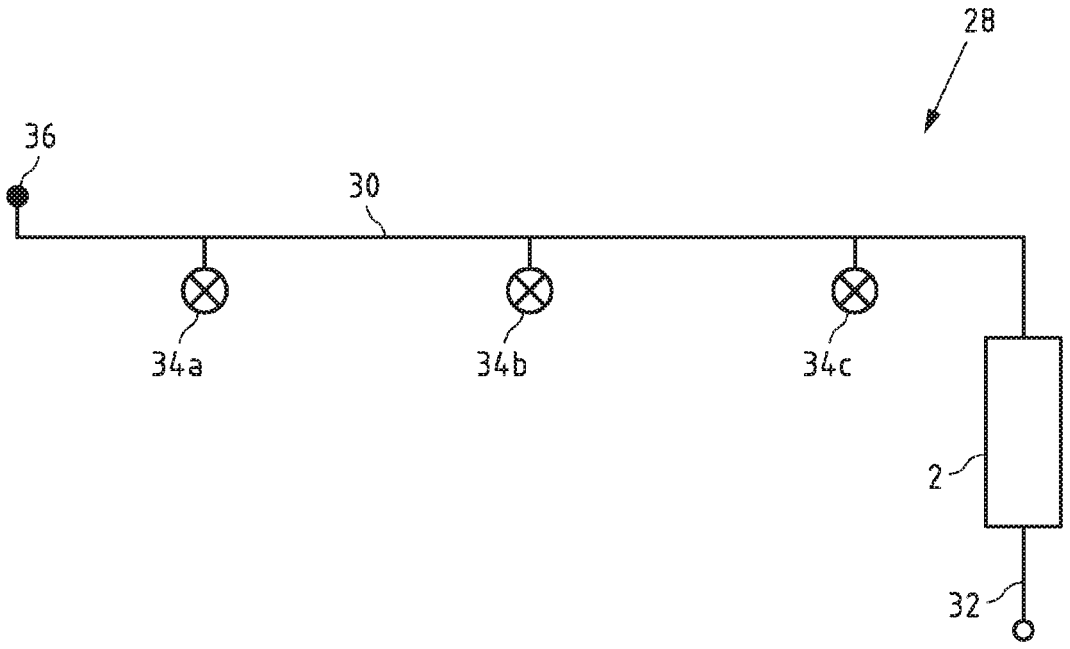

With regard to further advantages and arrangements of the method according to the invention reference is made to the above details and sub-claims regarding the device and the system according to the invention and also to the drawings, in which:

FIG. 1 is a schematic view of a first exemplary embodiment of the device according to the invention in a sectional representation, FIG. 2 is a perspective, schematic view of the first exemplary embodiment of the device according to the invention, FIG. 3 is a schematic view of a second exemplary embodiment of the device according to the invention, FIG. 4 is a perspective, schematic view of the second exemplary embodiment of the device according to the invention, and FIG. 5 is a schematic view of an exemplary embodiment of a system according to the invention.

FIG. 1 shows a schematic view of an exemplary embodiment of the device 2 according to the invention for automatic flushing. The device 2 comprises a connection 4 for a liquid conduit, a connection 6 for a drainage conduit, and a flushing valve 8, which is arranged between the connections 4, 6 for the liquid conduit and drainage conduit.

The flushing valve 8 includes according to the invention a multiple valve, in the form of a quadruple magnetic valve in this exemplary embodiment. The quadruple magnetic valve comprises a total of four magnetically controlled valves 10 of identical cross-section, of which only two valves 10*a*, 10*b* are visible in the view of FIG. 1. The valves 10 of the quadruple magnetic valve are thereby arranged parallel to one another, i.e. the liquid pathway from the connection 4 for a liquid line can run next to one another over the individual valves 10. The volume flow through the flashing valve 8 can thus be regulated in a simple manner via the number of open valves 10. For example, four valves 10 each having a flow rate of 12 l/min (±10%) are used, whereby the volume flow can be regulated depending on the connected liquid line or also depending on the operating mode, in the stages 0→12→24→36→48 l/min (in each case±10%).

The device 2 furthermore comprises a backflow vessel 12, which is arranged between the flushing valve 8 and the connection 6 to a drainage conduit. The backflow vessel 12 provides a containment volume, that for example in the case of a volume flow through the open flushing valve 8 that is too high for the drainage conduit or a blocked drainage conduit, prevents liquid drained by the flushing from being forced back into the liquid line. In the event of a backflow the backflow vessel 12 first of all fills with liquid before this reaches the liquid conduit.

A free discharge 14 is arranged between the flushing valve 8 and the connection 6 to a drainage conduit. In this way a run-off of the liquid from the liquid conduit when the flushing valve 8 is open can be ensured in a simple manner. A jet control 16 controls the flow of the liquid with regard to its jet shape and flow rate. The jet control 16 allows a uniform and constant outflow jet in the free discharge 14.

An odour trap 18 is arranged between the flushing valve 8 and the connection 6 for a drainage conduit. The odour trap 18 prevents an escape of gases from the drainage conduit, in particular into the free discharge 14.

The device comprises a backflow sensor 20, which monitors whether liquid from the drainage conduit flows back due to a backflow in a flushing procedure and threatens to enter the liquid line, wherein the liquid level in the backflow vessel 12 and/or in the free discharge 14 is detected. If a backflow is detected by the backflow sensor 20, then by closing the flushing valve 8 liquid from the discharge conduit can be prevented from reaching the liquid conduit. A floating sensor or a floating switch can be provided as backflow sensor 20.

The backflow vessel 12 is dimensioned so that the volume of the backflow vessel 12 is sufficient to close the flushing valve 8 within its switching time in the event of a backflow, before liquid from the drainage conduit can flow in.

A flow sensor 22 is arranged between the connection 4 for a liquid conduit and the flushing valve 8 and can detect a flow of the liquid. This can serve to monitor a flushing procedure and in particular to detect leakages. If for example the flushing valve 8 does not fully close or is not tight, then a flow is recorded at the flow sensor 22 and the leak is detected.

A control unit 24 controls the opening and closing of the individual valves 10 in the flushing valve 8. The control unit 24 also receives information form the backflow sensor 20 and flow sensor 22. The control unit 24 automates the flushing procedures and can in addition also automatically close the flushing valve 8 if the backflow 20 detects a backflow.

FIG. 2 shows for purposes of clarification a perspective, schematic view of the first exemplary embodiment of the device 2 according to the invention, with the same reference numerals as in FIG. 1. In addition a housing 26 is provided. In FIG. 2 a non-circular shape or a non-circular cross-section of the backflow vessel 12 can be recognised, which here is in the shape of a rounded square. Further cross-sectional shapes are however also conceivable.

FIG. 3 shows a schematic view of a second exemplary embodiment of the device 2 according to the invention. In FIGS. 3 and 4 the same reference numerals are chosen for the corresponding elements as in FIGS. 1 and 2. The main differences compared to the first exemplary embodiment are the use of a pressure switch as backflow sensor 20 and also the circular shape and the circular cross-section of the free discharge 14 and of the backflow vessel 12, as can be recognised from the perspective view in FIG. 4.

FIG. 5 shows a schematic view of an exemplary embodiment of a system 28 according to the invention with a device 2 according to the invention for the automatic flushing of a liquid conduit 30 into a drainage conduit 32. The liquid conduit 30 can include multiple straight lines and loop lines, and is illustrated in a simplified manner in FIG. 3 as a linear line with multiple consumers 34*a*, 34*b*, 34*c* arranged behind one another. The liquid conduit 30 is supplied with liquid from a liquid source 36. If for example the consumer 34 located behind the liquid source 36 is not used for a prolonged period, the stagnation of the liquid at the end of the liquid conduit 30 can cause problems such as deposits or the formation of germs.

This problem can now be overcome with the device 2. The device 2 allows an automatic flushing and thus an at least partial replacement of the liquid in the liquid conduit 30. Thereby one or more of the valves 10 in the flushing valve 8 can be opened depending on the size of the liquid conduit 30 or depending on the volume to be achieved by flushing procedure, and a flushing procedure can thereby be initiated.

In the case of a flushing procedure with a backflow in the drainage conduit 32 the backflow vessel 12 prevents a return flow of the liquid from the drainage conduit 32, since first of all the backflow volume of the backflow vessel 12 is filled. In addition the backflow sensor 20 can be used to close the flushing valve 8 automatically in the case of a backflow.

The invention claimed is:

1. A device for the automatic flushing of liquid lines with a liquid, the device comprising
   at least one connection for a liquid conduit,
   at least one connection for a drainage conduit,
   a flushing valve arranged between the connections for the liquid conduit and drainage conduit,
   a free discharge arranged between the flushing valve and the connection drainage conduit, and
   a backflow vessel arranged between the free discharge and the drainage conduit,
   wherein the flushing valve comprises a multiple valve with parallel valves arranged next to each other, the device further comprising a control unit, which controls the opening and closing of each valve of the multiple valves in the flushing valve, wherein the control unit is configured to vary the number of parallel opened valves from the multiple valve in a flushing procedure, depending on the size of the liquid line, with which the device is connected, wherein the flushing valve, the free discharge, and the backflow vessel are integrally connected, and wherein the backflow vessel has a volume so that, in the instance when the drainage conduit cannot drain all of the liquid, the backflow vessel is configured to fill with the liquid, thereby preventing the liquid from being forced upstream.

2. The device according to claim 1, wherein the multiple valve has parallel magnetic valves.

3. The device according to claim 2, wherein the multiple valves comprises a quadruple magnetic valve.

4. The device according to claim 1, wherein a backflow sensor is provided.

5. The device according to claim 4, wherein the backflow sensor comprises a floating sensor.

6. The device according to claim 1, wherein an odour trap is arranged between the flushing valve and the connection for a drainage conduit.

7. The device according to claim 1, wherein the flushing valve comprises at least one flow limiter.

8. The device according to claim 7, wherein the flushing valve comprises at least one flow limiter in each valve of the multiple valve.

9. The device according to claim 1, wherein a flow sensor is provided.

10. A system of liquid lines,
   with the device according to claim 1,
   with a liquid conduit connected to the device and
   with a drainage conduit connected to the device.

11. A method for the automatic flushing of liquid lines,
   using the device according to claim 1,
   wherein flushing procedures are envisaged in which the multiple valve is opened for flushing a liquid conduit and is closed again after a flushing duration, and wherein the opening and closing of the individual valves in the flushing valve are controlled via a control unit, wherein in a flushing procedure the number of parallel opened valves from the multiple valve is varied, depending on the size of the liquid line, with which the device is connected.

12. The method according to claim 11, wherein the opening and closing of the multiple valve is controlled via a control unit.

13. The method according to claim 12, wherein the number of valves in the multiple valve to be opened in a flushing procedure is fixed in a time-dependent, temperature-dependent manner and/or depending on the flow through the liquid conduit.

14. The method of claim 12, wherein the control unit is time dependent.

15. The method of claim 12, wherein the control unit is temperature dependent.

16. The method of claim 12, wherein the control unit is dependent on the flow through the liquid conduit.

17. The method according to claim 11, wherein a flushing procedure is automatically ended in case of a backflow.

18. The device according to claim 1, wherein the free discharge is arranged between the flushing valve and the connection for a draining conduit with a jet controller.

* * * * *